US008752336B1

(12) United States Patent
Ozsuer

(10) Patent No.: US 8,752,336 B1
(45) Date of Patent: Jun. 17, 2014

(54) INFLATABLE BLAST PROOF STRUCTURE

(71) Applicant: Ilyas Cem Ozsuer, Istanbul (TR)

(72) Inventor: Ilyas Cem Ozsuer, Istanbul (TR)

( * ) Notice: Subject to any disclaimer, the term of this patent is extended or adjusted under 35 U.S.C. 154(b) by 0 days.

(21) Appl. No.: 13/951,550

(22) Filed: Jul. 26, 2013

Related U.S. Application Data

(63) Continuation of application No. 13/783,300, filed on Mar. 3, 2013, now abandoned.

(51) Int. Cl.
*E04B 1/34* (2006.01)
*E04B 1/16* (2006.01)

(52) U.S. Cl.
CPC ..... *E04B 1/165* (2013.01)
USPC ..... 52/2.15; 52/2.18

(58) Field of Classification Search
CPC ..... E04H 15/20; E04H 2015/201; E04H 2015/202; E04H 9/06; B64G 2001/224; E04B 1/169; E04B 2001/3264; E04B 1/166; E04B 2001/1939; E04C 3/005
USPC ..... 52/2.13, 2.14, 2.15, 2.17, 2.18, 2.21, 52/2.23, 2.24; 135/95, 96
See application file for complete search history.

(56) References Cited

U.S. PATENT DOCUMENTS

| | | | | |
|---|---|---|---|---|
| 3,388,509 | A * | 6/1968 | Mora | 52/2.15 |
| 4,746,471 | A * | 5/1988 | Hale | 264/32 |
| 6,797,379 | B2 * | 9/2004 | Van Dijk et al. | 428/401 |
| 7,273,430 | B2 * | 9/2007 | Ashino et al. | 473/535 |
| 7,552,555 | B2 * | 6/2009 | Pellecuer et al. | 40/610 |
| 7,811,495 | B2 * | 10/2010 | Dagher et al. | 264/228 |
| 8,001,985 | B1 * | 8/2011 | Conner | 135/96 |
| 8,166,711 | B2 * | 5/2012 | Lamke | 52/2.18 |
| 8,499,500 | B2 * | 8/2013 | Lamke | 52/2.18 |
| 8,522,486 | B2 * | 9/2013 | Dagher et al. | 52/2.15 |
| 2006/0174549 | A1 * | 8/2006 | Dagher et al. | 52/86 |
| 2007/0175577 | A1 * | 8/2007 | Dagher et al. | 156/229 |

* cited by examiner

*Primary Examiner* — William Gilbert
*Assistant Examiner* — Gisele Ford
(74) *Attorney, Agent, or Firm* — Gokalp Bayramoglu

(57) ABSTRACT

An inflatable blast proof structure in a pack proposed. The structure can easily be transported to a remote site. Air compressors can inflate the pack. The structures can be in different shapes. One of those shapes used is hexagon. Individual structures can be connected together to create a greater structure complex.

22 Claims, 10 Drawing Sheets

INFLATABLE BLAST PROOF STRUCTURE

This application is a continuation application of application Ser. No. 13/783,300 filed at United States Patent and Trademark Office on Mar. 3, 2013 by the present inventors, which is incorporated herein by reference.

BACKGROUND OF THE INVENTION

Background

There is an ever growing terrorist threat in the world. The main targets of the terrorist organizations around the world are small military stations along the borders close to where terrorist organizations established. These military stations also known as military police stations are usually poorly made structures and therefore they may be defenseless against terrorist attacks. New police stations called the "castle stations" may be built and used to meet the requirements of protecting habitants from terrorist attacks. However due to harsh weather conditions and transportation difficulties in rural areas it may be challenging to build these "castle stations" and often helicopters are used to carry construction equipment which makes it impractical to build these stations.

SUMMARY OF THE INVENTION

A fast inflatable blast proof structure in a pack proposed. The structure can easily be transported to a site by helicopters. Air compressors can inflate the pack. The structures can be in different shapes. One of those shapes used is hexagon. Individual structures can be connected together to create a greater structure complex.

DETAILED DESCRIPTION

A container box, when inflated will turn into a tent like building. Columns and walls are made of carbon-fiber composite material. Once inflated columns are treated with resin to harden them and then filled with concrete to act as columns of the building. The walls will be pretreated and attached to the columns. The walls will be filled with durable material such as concrete, sand or a composite material to strengthen them.

The building is blast resistant and bullet proof. Therefore the building can be used in battle zones.

The inflatable building provides shelter for its habitants from attacks. It can be transported easily and easy to deploy. During manufacturing one module of shelter is placed in each box. Each shelter will have about 64 square meters of usable area when inflated. The deployment of the shelter and finishing up the structure by adding concrete to it upon deployment will at most take about couple of days. The building once deployed and finished can withstand external threats such as earthquake, explosions, and bullets.

The building is a portable, light and compact structure. It can be deployed by a helicopter. From the start of inflating the building, it can be ready for residency within 48 hours. It can be fully furnished and ready to be lived in within one week. It is a multi-modular structure. Easy to build, easy to use, easy to maintain and easy to fix during and after a combat. It is blast resistant against RPG, hand grenade, mortar and plastic explosives. It is bullet proof against high velocity bullets and 0.30 to 0.45 caliber bullets. It is fire proof. It is easy to clean and easy to repair. It is self sustainable. The roof can carry solar panel and rain water collection system is used. The structure is portable. FRP (Fiber Reinforced Polymer) material is used. Carbon-fiber composite material is preferred, but other materials such as fiber-glass and Kevlar can also be used. Resin infused Carbon-Fiber FRP is used because of its strength to weight ratio. The structure is compact. It can be folded and fit into a container. Container is a light container and portable. It is water resistant, wind resistant, heat and cold resistant. The container acts as a protective shell during the period of storage of the structure. The structure is inflatable and water proof against snow, rain, extreme winds, freezing cold and extreme hot.

Figure 1:
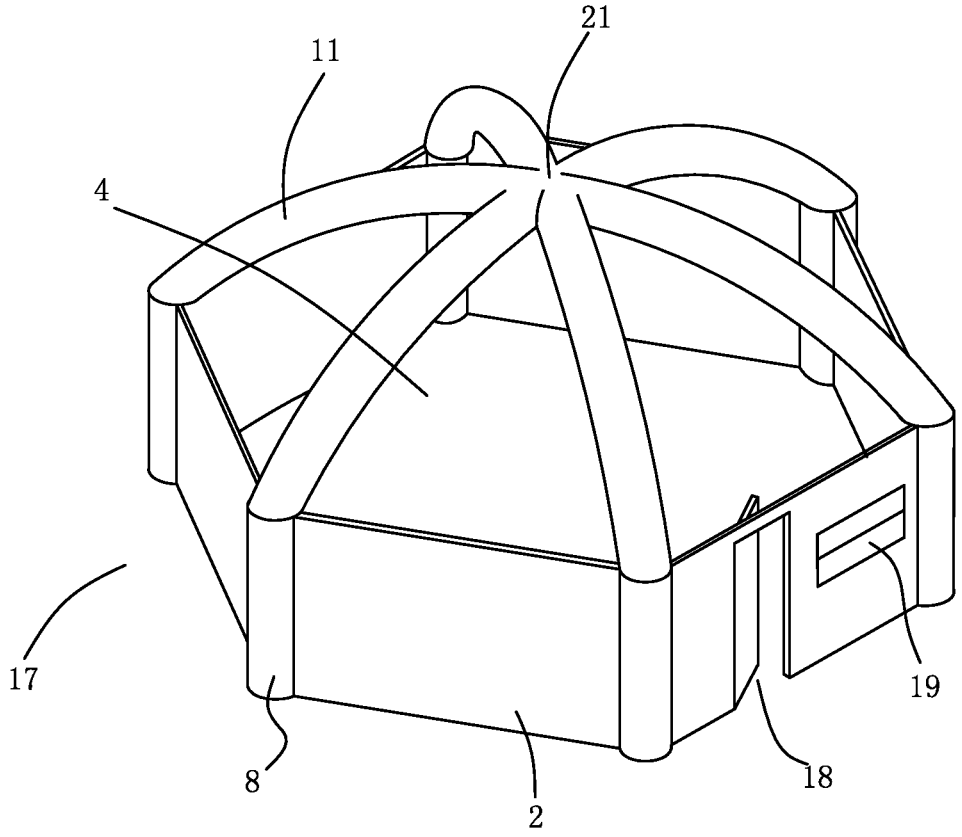
FIG. 1 shows the blast resistant inflatable building

FIG. 1 shows Blast Resistant Inflatable Building (BRIB) 17 which comprises columns 8, walls 2, door 18, windows 19, ceiling arches 11, roof sections 4 and ceiling arch center point 21 wherein all ceiling arches 11 are connected to. In FIG. 1, BRIB 17 is shown in a hexagonal shape. The shape can be triangle, rectangle, pentagon, hexagonal or any other suitable shape. In this embodiment hexagonal shape is used. There are six columns 8 that are connected to each other with six walls 2. Each column 8 has ceiling arch 11 connected to it wherein ceiling arches 11 connect to each other at ceiling arch connector 21. Before BRIB 17 is packed in a box, roof sections 4 may be attached to ceiling arches 11 and walls 2. This way, when the box is opened, ceiling arches 11 are inflated. Roof sections 4 are formed between ceiling arches 11 as they are attached to ceiling arches 11 and walls 2 before inflatable building is packed in a box. Alternatively, BRIB 17 can be packed in a box without attaching roof sections 4 to ceiling arches 11 and walls 2. In that setup, roof sections 4 are attached to ceiling arches 11 and walls 2 after the box is opened and after ceiling arches 11 are inflated.

Figure 2:
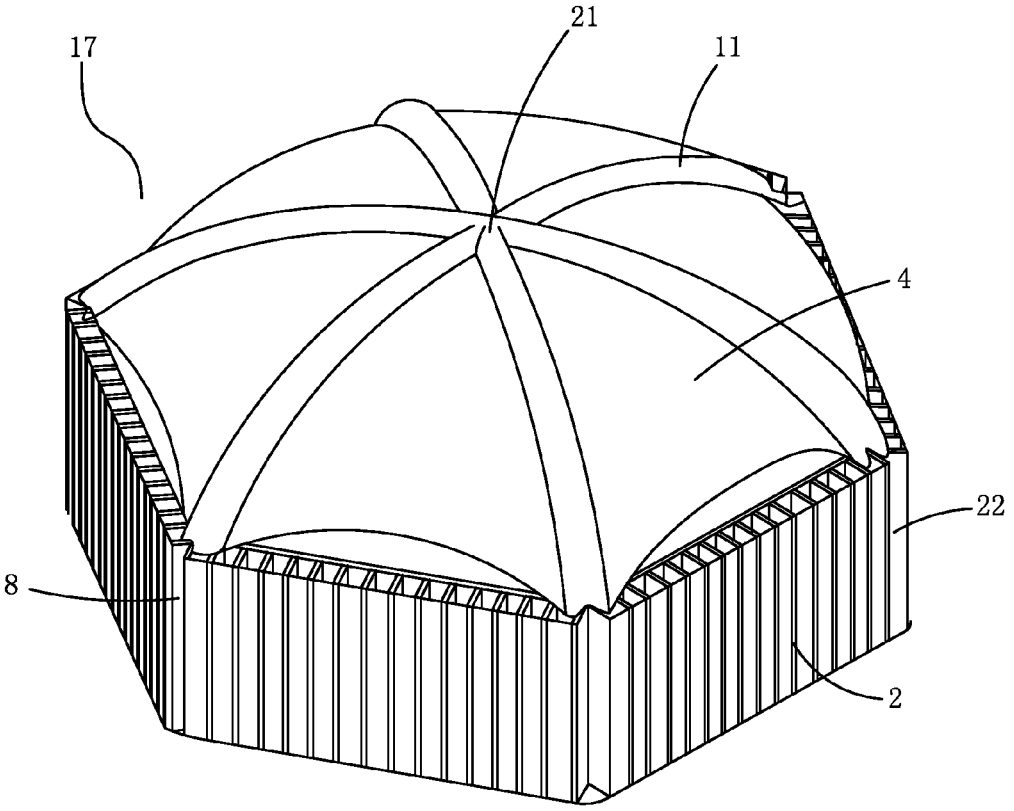
FIG. 2 is another view of the blast resistant inflatable building

FIG. 2 shows another view of Blast Resistant Inflatable Building (BRIB) 17. Hexagonal shape is used to form BRIB 17 in this embodiment. However any other shape could be used. There are eight columns 8. Each column 8 is connected to another column by wall 2. The top of each column 8 are connected to ceiling arch center point 21 by ceiling arches 11. There are six ceiling arches 11 and there is one ceiling arch center point 21. Roof 4 is placed between two ceiling arches 11. BRIB 17 is automatically inflated when the box is opened. Alternatively, air can be inserted into ceiling arch center point 21, and the air moves into ceiling arches 11 and columns 8 such that BRIB 17 structure inflates.

Figure 3:
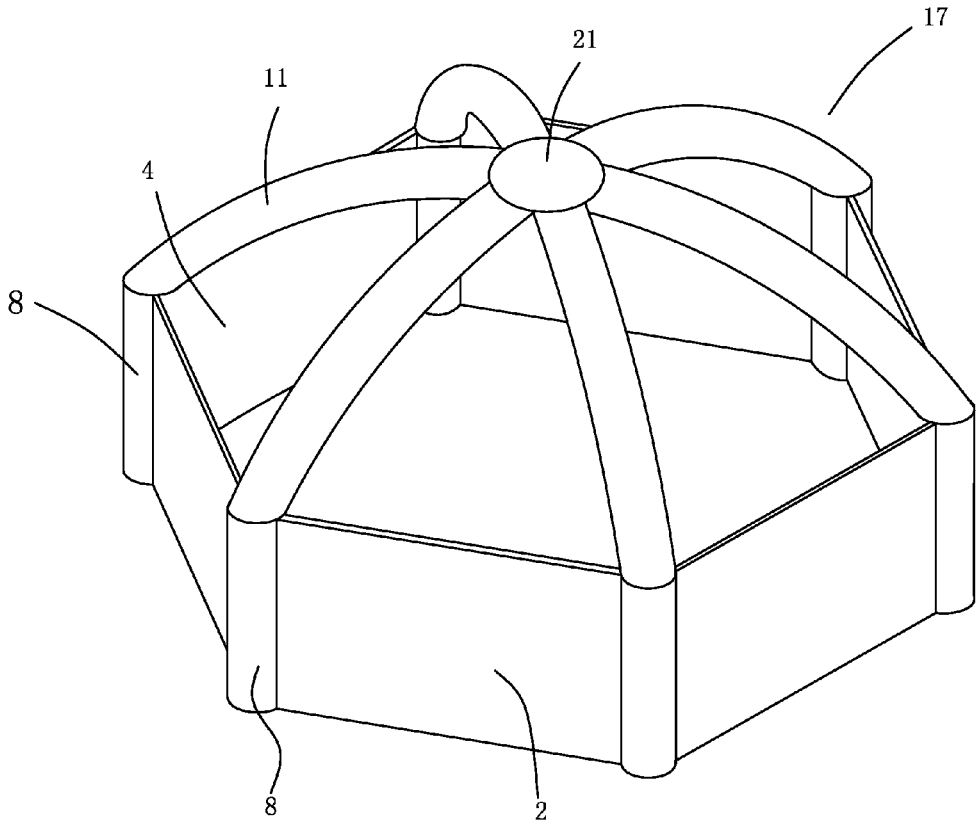
FIG. 3 is another view of the blast resistant inflatable building

FIG. 3 shows another view of Blast Resistant Inflatable Building 17. Hexagonal shape is used to form BRIB 17 in this embodiment. However any other shape could be used. There are eight columns 8. Each column 8 is connected to another column by wall 2. The top of each column 8 are connected to ceiling arch center point 21 by ceiling arches 11. There are six ceiling arches 11 and there is one ceiling arch center point 21. Roof 4 is placed between two ceiling arches 11 and walls 2. BRIB 17 is either automatically inflated or manually inflated from ceiling arch center point 21. When air is inserted into ceiling arch center point 21, the air moves into ceiling arches 11 and columns such that BRIB 17 structure inflates.

Figure 4:
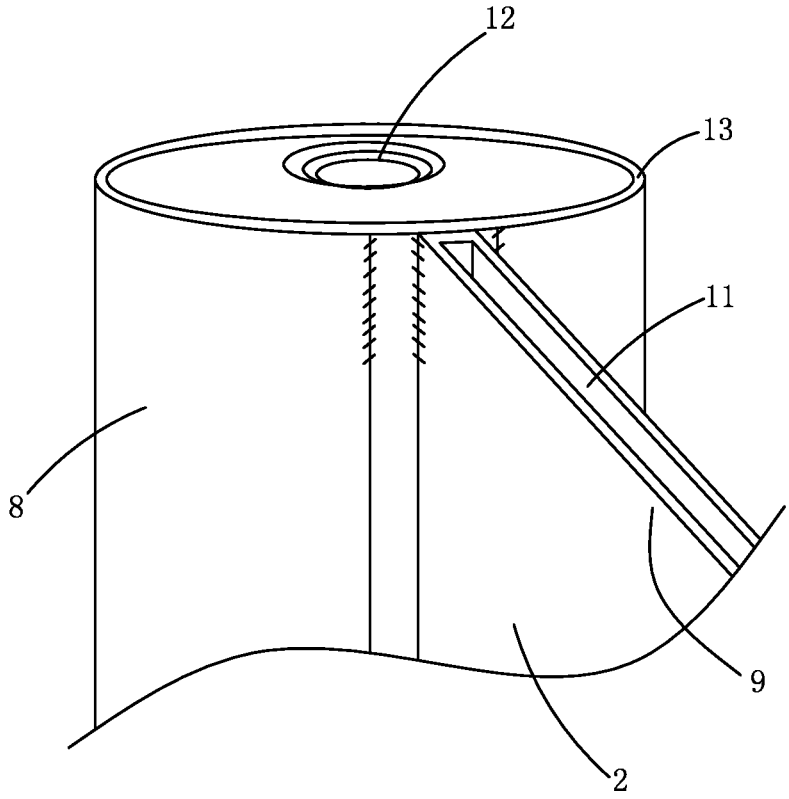
FIG. 4 shows the details of column and wall

FIG. 4 shows column 8 and wall 2 connected to each other. Column 8 has shell 13 and inner part 12. Shell 13 is made of bi-axial carbon fiber tubes. However any other material can be used in shell 13. Wall 2 has inner part 11 and side 9. Wall 2 material is pretreated carbon fiber panel. The design is portable therefore a collapsible mechanism is possible.

Figure 5:
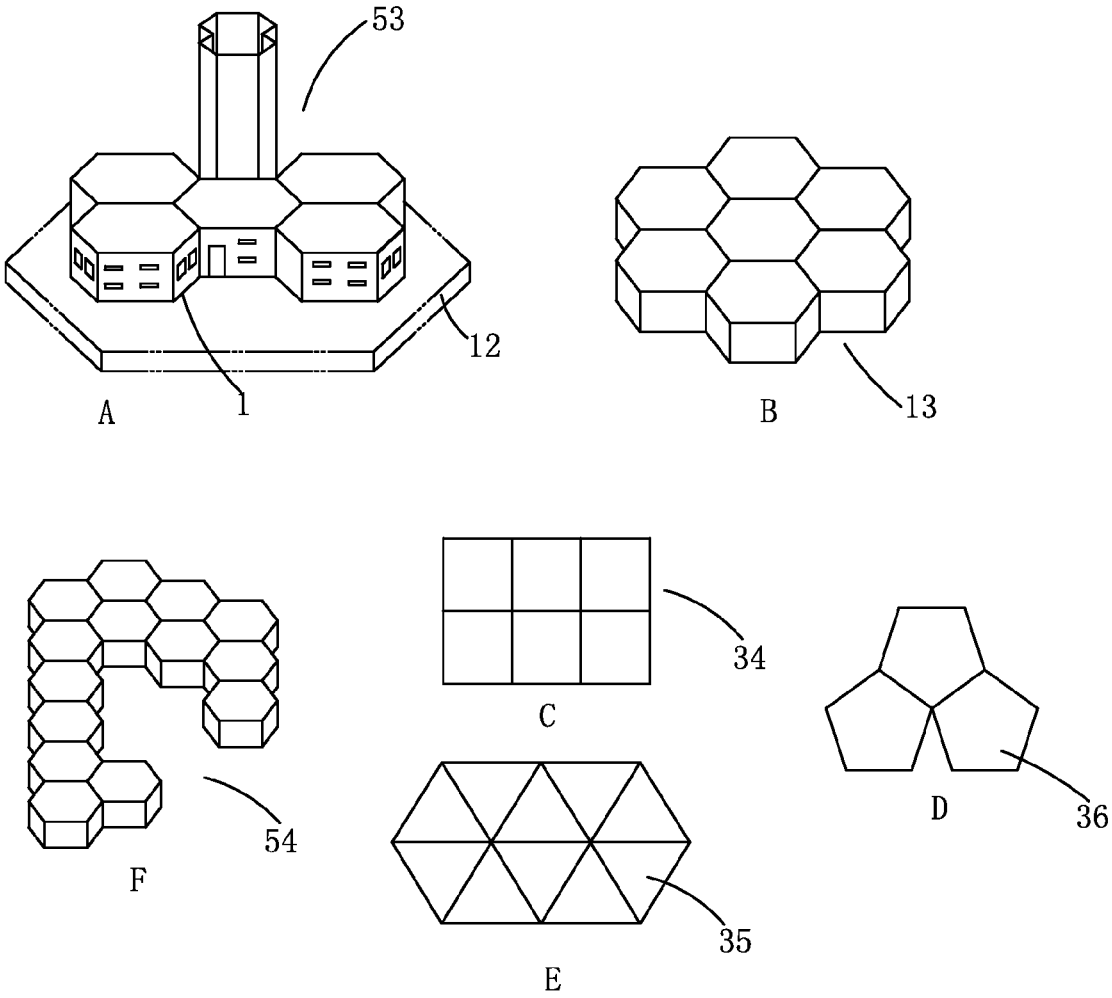
FIG. 5 A through F show how inflatable structures can be combined together to generate a larger structure

FIG. 5A shows how BRIB 17 can be combined with other inflatable buildings to form larger structure 53. Wall 12 can be placed around larger structure 53. FIG. 5B shows multiple BRIB 17 are connected together. The shape of BRIB 17 in FIG. 5B is hexagonal. FIG. 5C shows inflatable buildings that are in rectangle shapes. FIG. 5D shows pentagon shapes and FIG. 5E shows triangle shapes. All these shapes can be used to build BRIB 17. FIG. 5F shows multiple inflatable buildings 17 in hexagonal shape being connected together to form a larger structure 54.

Figure 6:
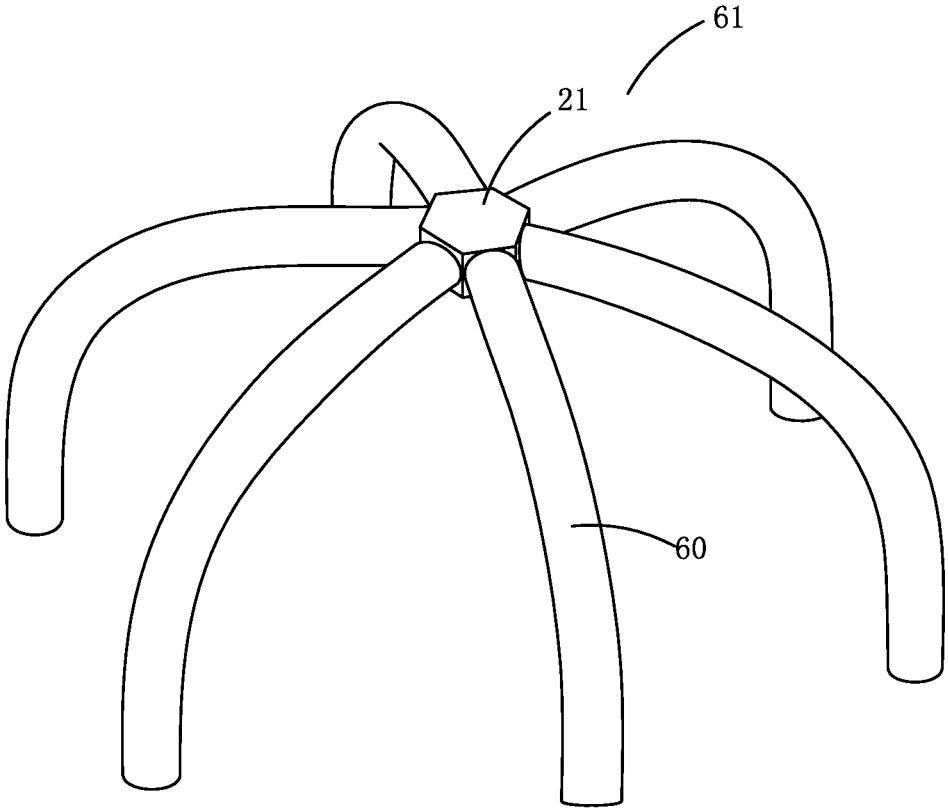
FIG. 6 shows the arch structure of the inflatable building
Figure 7:
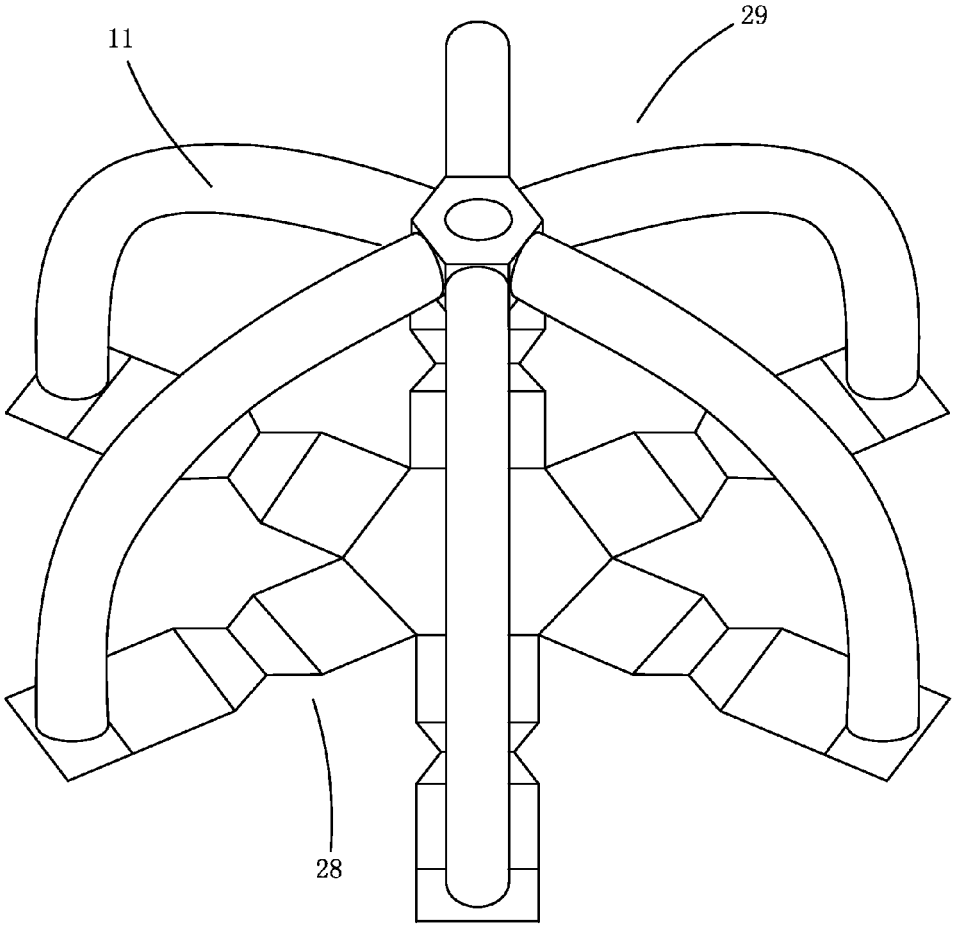
FIG. 7 shows arches and walls in their opened form FIG. 8 A through D shows how arches and walls are connected together in open and closed form

Another embodiment of the invention is shown in FIG. 6. In FIG. 6 ceiling arches 60 connect to each other at ceiling arch center unit 21. Structure 61 does not have separate columns. Instead, ceiling arch 60 is a continuous structure from ceiling arch center unit 21 to floor. Each ceiling arch 60 is connected to ceiling arch center unit 21. The shape of the structure in FIG. 7 is hexagonal. Any other shape could be used in which case the number of arches 60 would change. For example if a rectangle shape is used then there would be four arches 60. If a triangle shape is used then three arches 60 would be used.

An embodiment of the invention is shown in FIG. 1. In this embodiment, each wall 2 of the hexagon shaped structure 17 is about 4 meters. Total span will be over 8 meters. The height of the walls 2 is about 2.10 meters. Ceiling arch center point 21, where all arches 11 and roof pieces 4 meet will be about 3.68 meters above ground. Columns 8 can be made from bi-axial carbon fiber tubes with a thickness of about 2 to 16 mm but preferably 6 to 8 mm. Arches 11 will have a total length of about 13 to 14 meters and a span of 8 meters from bottom center to center of the column 8. Arches 11 are connected to the outer shell, the I-Box, and also are connected at the ceiling arch center point 21. Wall 2 and roof 4 are either readily connected or are attached to the structure 17 once it is inflated. All system elements are present inside of one I-box. Each I-box contains only one module of Blast Resistant Inflatable Building (BRIB) 17. Each BRIB 17 has approximately 64 $m^2$ of living space, and multiple modules can be connected side by side as shown in 5A. Selecting hexagon shape makes it easier to connect BRIB 17 together to generate a larger structure, however any other shape can be used for BRIB 17. BRIB 17 is an inflatable module and therefore Fiber Reinforced Polymer (FRP) material is used. In this embodiment of the invention, wall 2 is a rectangle and wall 2 dimensions are given below. These dimensions are approximate dimensions:

a. Height: 210 cm.
b. Width: 400 cm.
c. Thickness: 5-7 mm.
d. Total Depth: 20 cm.

Walls 2 are pretreated carbon fiber panels. BRIB 17 is portable therefore a collapsible mechanism is possible. Wall 2 will close in like an accordion instrument as shown in FIG. 7. This set up saves space during transportation. Once fully opened and attached to the arches 11 as shown in FIG. 1 or FIG. 2, walls 2 are filled with a material that will stop the fragments from an explosion, or bullets fired from large caliber weaponry.

Roof 4 is in curved triangular shape and is made of pretreated carbon fiber panels. Roof 4 approximate dimensions are:

e. Height: 158 cm.
f. Length: 300 cm.
g. Width: 400 cm.
h. Thickness: 5-7 mm.
i. Total Depth: 20 cm.

Arch 11 has a tube shape with a thickness of about 6 to 8 mm. Tube diameter is about 50 cm. The tube has an outer skin of vacuum raisin infusion. The tube has an inner bladder, which will inflate the structure. The inner bladder also acts as an inner cast during vacuum infusion process. Bi-axial tube approximate dimensions are j. Height: 368.54 cm.
k. Length: 635 cm.
l. Span: ~350 cm.
m. Tube Detail:
Hatch Dimensions (Hexagonal):
n. Height: 55 cm.
o. Length of each side: 55 cm.

Ceiling arch center point 21 acts as the middle topside of the BRIB 17 structure. As shown in FIG. 6. When the structure is in a box, the only way to inflate the structure is through ceiling arch center point 21. When opened, ceiling arch center point 21 will provide access to each bladder in each arch 11, as well as the back-up bladder in case the bladder leaks air for any reason. Ceiling arch center point 21 is also connected to the bottom part of the box. A cable stretching from the bottom to the ceiling arch center point 21 will limit the height of the structure while being inflated therefore proving the shape desired.

Figure 8:
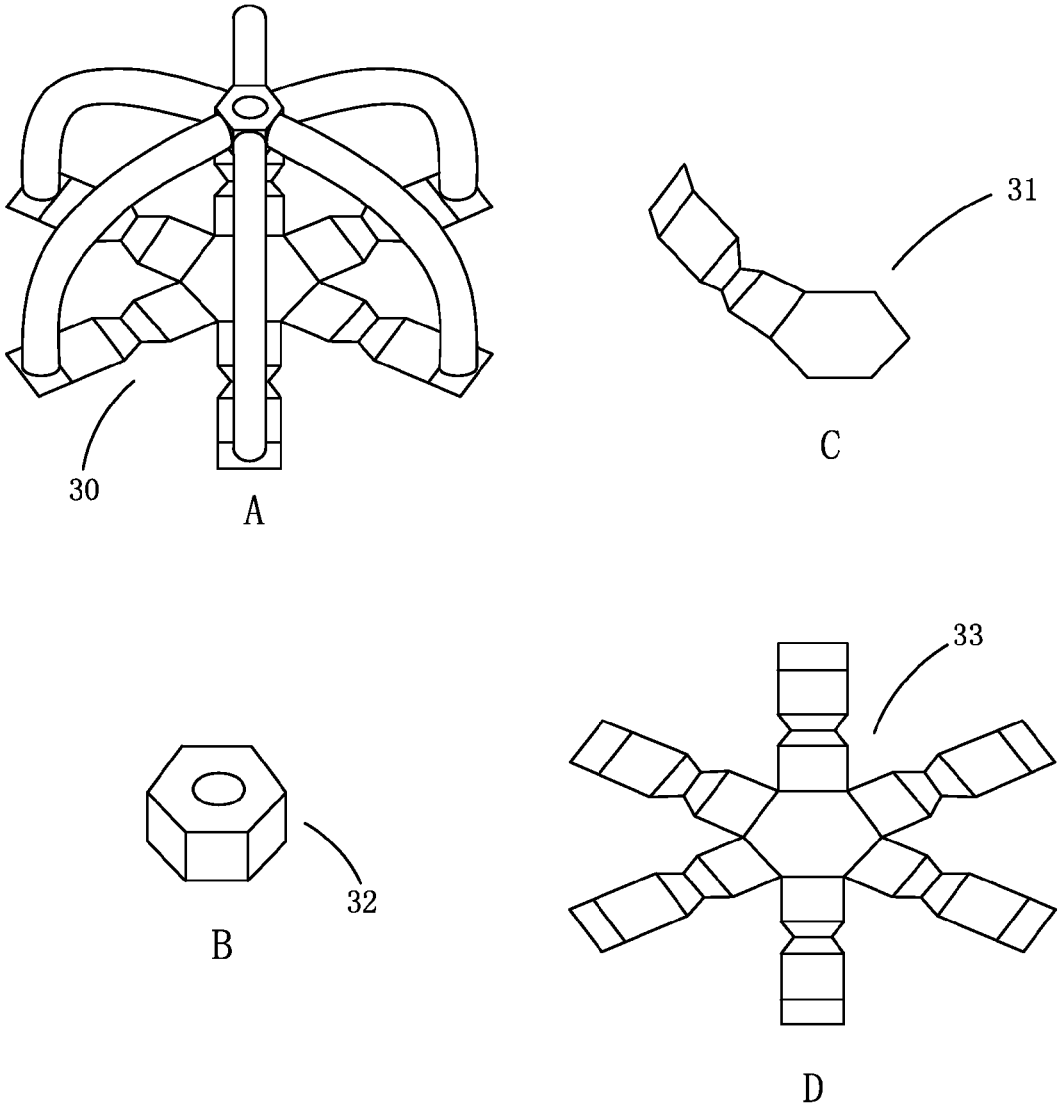

FIG. 8 shows ceiling arches and Wall will close in like an accordion instrument. This set up saves space during transportation. Once fully opened and attached to the arches 11 as shown in FIG. 1 or FIG. 2, walls 2 are filled with a material that will stop the fragments from an explosion, or bullets fired from large caliber weaponry.

Figure 9:
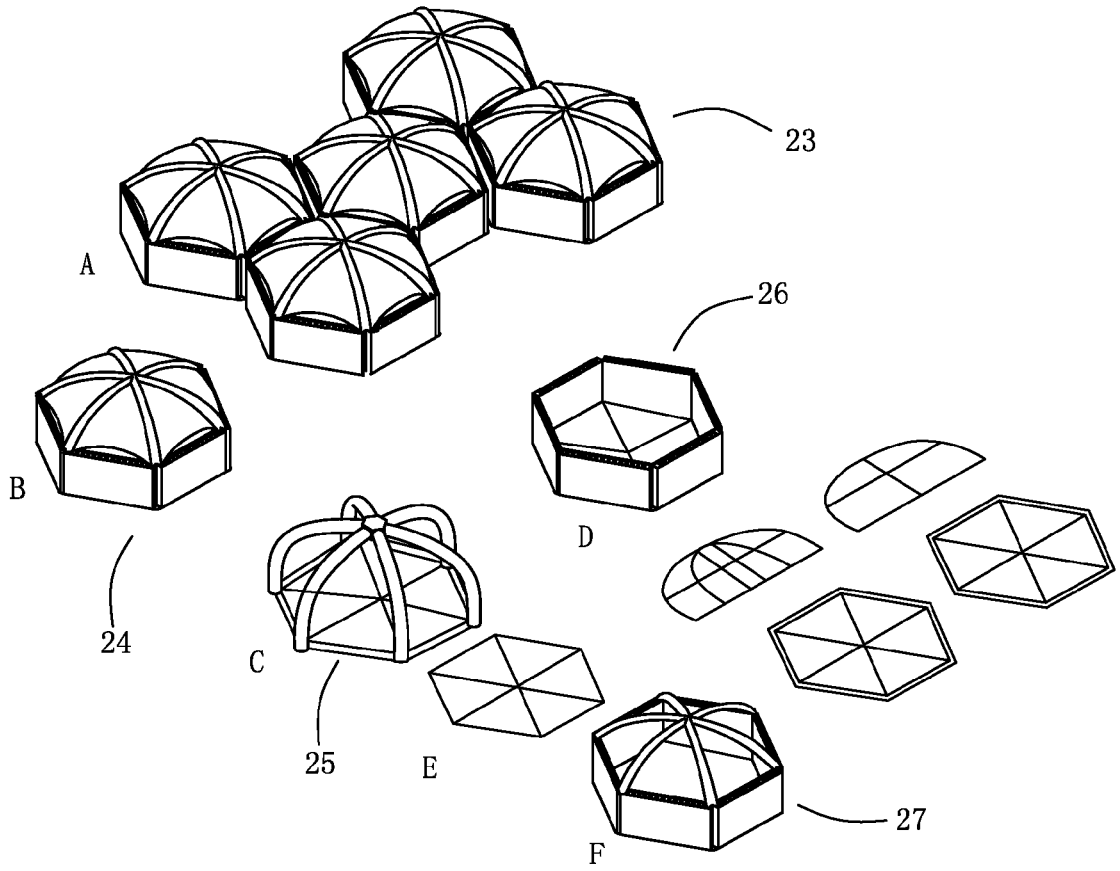
FIG. 9A shows multiple blast resistant inflatable building structure and FIG. 9 B through F show blast resistant inflatable building details

FIG. 9A shows how multiple BRIB 17 are connected together to form a larger structure 23. FIG. 9B shows single BRIB 17. FIG. 9C shows ceiling arches and roof sections. FIG. 9D shows walls of the BRIB 17. FIG. 9F shows walls 2, columns 8 and ceiling arch arches 11 connected together.

Figure 10:
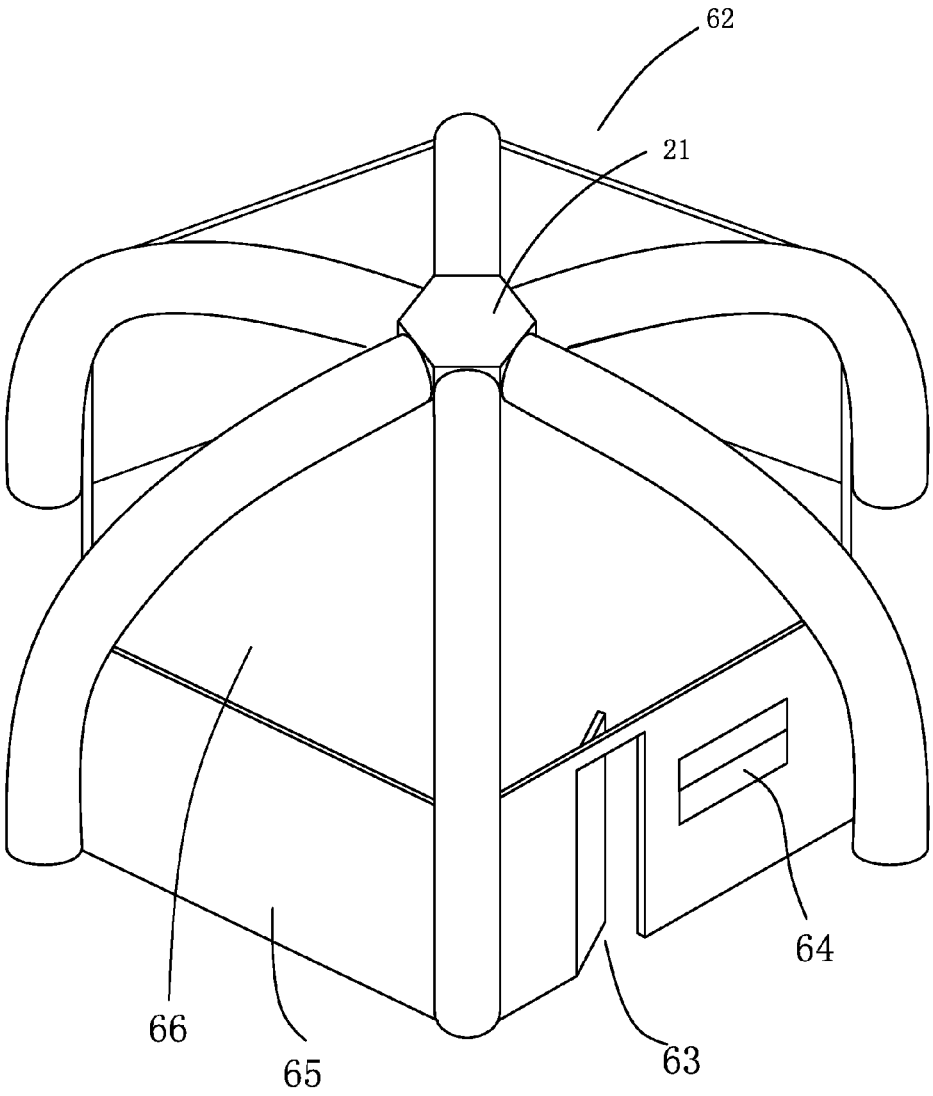
FIG. 10 shows multiple blast resistant inflatable building structure where separate columns are replaced with arches that extend from ground to ceiling arch center point

FIG. 10 shows another embodiment of the invention. In FIG. 10, blast resistance inflatable building 62 has ceiling arches 60 of FIG. 6. Ceiling arches 60 connect to each other at ceiling arch center unit 21. BRIB 62 does not have separate columns. Instead, ceiling arch 60 is a continuous structure from ceiling arch center unit 21 to floor. Each ceiling arch 60 is connected to ceiling arch center unit 21. Wall 65 is located between two ceiling arches 60. Roof sections 66 are attached between walls 65 and ceiling arches 60 for each segment. The shape of the structure in FIG. 7 is a hexagonal shape. There are six ceiling arches 60, six roof sections 66 and six walls 65. Any other shape could be used in which case the number of arches 60, roof sections 66 and walls 65 would change. For example if a rectangle shape is used then there would be four arches 60, four roof sections 66 and four walls 65.

In this embodiment, each wall 65 of the hexagon shaped BRIB 62 is about 4 meters. Total span will be over 8 meters. The height of the walls 65 is about 2.10 meters. Ceiling arch center point 21, where all arches 60 and roof sections 66 meet will be about 3.68 meters above ground. There are no columns used in this embodiment as ceiling arches 60 are continuous structure and expands from the floor to ceiling arch center point 21. Ceiling arches 60 will have a total length of about 14 meters to 16 meters. The half point length for ceiling arch 60 is about 7 meters and spans over about 4 meters. Ceiling arches 60 are connected to the outer shell, the I-Box, and also are connected at the ceiling arch center point 21. Wall 65 and roof section 66 are either readily connected or are attached to the structure 17 once it is inflated. All system elements are present inside of one I-box. Each I-box contains only one module of Blast Resistant Inflatable Building (BRIB) 62. Each BRIB 62 has approximately 64 $m^2$ of living space, and multiple modules can be connected side by side as shown in 5A. Selecting hexagon shape makes it easier to connect BRIB 62 together to generate a larger structure, however any other shape can be used for BRIB 62. BRIB 62 is an inflatable module and therefore Fiber Reinforced Polymer (FRP) material is used. In this embodiment of the invention, wall 65 is a rectangle and wall 65 dimensions are given below. These dimensions are approximate dimensions:

p. Height: 210 cm.
q. Width: 400 cm.
r. Thickness: 5-7 mm.
s. Total Depth: 20 cm.

Walls 65 are pretreated carbon fiber panels. BRIB 62 is portable therefore a collapsible mechanism is possible. Wall 65 will close in like an accordion instrument as shown in FIG. 7. This set up saves space during transportation. Once fully opened and attached to the arches 60 as shown in FIG. 6, walls 65 are filled with a material that will stop the fragments from an explosion, or bullets fired from large caliber weaponry.

Roof section 66 is in curved triangular shape and is made of pretreated carbon fiber panels. Roof section 66 approximate dimensions are:

t. Height: 158 cm.
u. Length: 300 cm.
v. Width: 400 cm.
w. Thickness: 5-7 mm.
x. Total Depth: 20 cm.

Ceiling arch 60 has a tube shape with a thickness of about 6 to 8 mm. Tube diameter is about 50 cm. The tube has an outer skin of vacuum raisin infusion. The tube has an inner bladder, which will inflates the structure. The inner bladder also acts as an inner cast during vacuum infusion process. Bi-axial tube approximate dimensions are y. Height: 368.54 cm.
z. Length: 635 cm.
aa. Span: ~350 cm.
bb. Tube Detail:
Hatch Dimensions (Hexagonal):
cc. Height: 55 cm.
dd. Length of each side: 55 cm.

Ceiling arch center point 21 acts as the middle topside of the BRIB 62 structure as shown in FIG. 6. When the structure is in a box, the only way to inflate the structure is through ceiling arch center point 21. When opened, ceiling arch center point 21 will provide access to each bladder in each ceiling arch 60, as well as the back-up bladder in case the bladder leaks air for any reason. Ceiling arch center point 21 is also connected to the bottom part of the box. A cable stretching from the bottom to the ceiling arch center point 21 will limit the height of the structure while being inflated therefore proving the shape desired.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A blast resistant inflatable building comprising: a plurality of columns; a plurality of walls connecting the plurality of columns; a plurality of arches; a ceiling arch center unit wherein the plurality of arches connect the plurality of columns to the ceiling arch center; a plurality of roof sections which are attached to the plurality of walls and the plurality of arches: wherein the blast resistant inflatable building is placed in a box and inflated such that air flow in the plurality of columns, the plurality of arches and the plurality of walls help set up the blast resistant inflatable building in its final standing form; wherein a concrete material is placed in the columns and a durable material is placed in the walls upon inflating the blast resistant inflatable building.

2. The blast resistant inflatable building of claim 1 wherein the shape of the walls in its final standing form can be selected from a group consisting of hexagonal, pentagon, rectangle and triangle.

3. The blast resistant inflatable building of claim 2 wherein each column comprises a shell and an inner part.

4. The blast resistant inflatable building of claim 3 wherein the shell is made of biaxial carbon fiber.

5. The blast resistant inflatable building of claim 2 wherein the wall comprises an inner part and a side.

6. The blast resistant inflatable building of claim 1 wherein the shape of the walls in its final standing form is hexagonal and each wall length is about 4 meters.

7. The blast resistant inflatable building of claim 1 wherein the shape of the walls in its final standing form is hexagonal and each wall height is about 2.10 meters.

8. The blast resistant inflatable building of claim 1 wherein the plurality of arches connect to the ceiling arch center point and the height of the ceiling arch center point is about 3.68 meters above ground.

9. The blast resistant inflatable building of claim 1 wherein the plurality of columns are made of bi-axial carbon fiber tubes with a thickness of about 2 to 16 mm.

10. The blast resistant inflatable building of claim 1 wherein the plurality of arches have a total length of about 13 to 14 meters and a span of 8 meters from bottom center to center of the column.

11. The blast resistant inflatable building of claim 1 wherein the blast resistant inflatable building has approximately 64 $m^2$ of living space.

12. The blast resistant inflatable building of claim 1 wherein Fiber Reinforced Polymer (FRP) material is used.

13. The blast resistant inflatable building of claim 1 wherein the walls and the roof sections are pretreated carbon fiber panels.

14. The blast resistant inflatable building of claim 1 wherein the durable material is selected from a group consisting of concrete, sand and a composite material.

15. A blast resistant inflatable building comprising: a plurality of arches: a plurality of walls connecting a plurality of arches; a ceiling arch center unit wherein the plurality of arches connect to: a plurality of roof sections which are attached to the plurality of walls and the plurality of arches; wherein the blast resistant inflatable building is placed in a box and inflated such that air flow in the plurality of arches and the plurality of walls help set up the blast resistant inflatable building in its final standing form: wherein a concrete material is placed in the arches and a durable material is placed in the walls upon inflating the blast resistant inflatable building.

16. The blast resistant inflatable building of claim 15 wherein the shape of the walls in its final standing form is hexagonal and each wall length is about 4 meters.

17. The blast resistant inflatable building of claim 15 wherein the shape of the walls in its final standing form is hexagonal and each wall height is about 2.10 meters.

18. The blast resistant inflatable building of claim 15 wherein the plurality of arches are made of bi-axial carbon fiber tubes with a thickness of about 6 to 8 mm.

19. The blast resistant inflatable building of claim 15 wherein the plurality of arches have a total length of about 13 to 14 meters and a span of 8 meters from bottom center to floor.

20. The blast resistant inflatable building of claim 15 wherein the blast resistant inflatable building has approximately 64 $m^2$ of living space.

21. The blast resistant inflatable building of claim 15 wherein Fiber Reinforced Polymer (FRP) material is used.

22. The blast resistant inflatable building of claim 15 wherein the walls and the roof sections are pretreated carbon fiber panels.

* * * * *